United States Patent [19]

Deal

[11] Patent Number: 4,898,190

[45] Date of Patent: Feb. 6, 1990

[54] ADJUSTABLE AIR DILUTION CIGARETTE WITH PRESSURE DROP COMPENSATION

[75] Inventor: Philip A. Deal, Winston-Salem, N.C.

[73] Assignee: R. J. Reynolds Tobacco Company, Winston-Salem, N.C.

[21] Appl. No.: 317,330

[22] Filed: Mar. 1, 1989

[51] Int. Cl.[4] ..... A24D 3/04; A24D 3/18

[52] U.S. Cl. ..... 131/336; 131/198.2

[58] Field of Search ..... 131/336, 198.1, 198.2

[56] References Cited

U.S. PATENT DOCUMENTS

| | | | |
|---|---|---|---|
| 3,695,274 | 10/1972 | Summers . | |
| 3,774,622 | 11/1973 | Steigerwald . | |
| 4,343,319 | 8/1982 | Cantrell . | |
| 4,380,241 | 4/1983 | Horsewell . | |
| 4,433,696 | 2/1984 | Adams . | |
| 4,526,183 | 7/1985 | Nichols et al. . | |
| 4,527,573 | 7/1985 | Hausermann . | |
| 4,532,943 | 8/1985 | Nichols et al. . | |
| 4,649,941 | 3/1987 | Norman et al. . | |
| 4,649,945 | 3/1987 | Norman et al. | 131/336 |
| 4,700,725 | 10/1987 | Geiszler, Jr. . | |

*Primary Examiner*—V. Millin

[57] ABSTRACT

An adjustable air dilution cigarettte with pressure drop compensation is disclosed. The cigarette comprises a tobacco rod and a filter element disposed within a filter assembly to which the tobacco rod is attached. The filter assembly comprises telescoping inner and outer sleeves, the inner sleeve having a plurality of air dilution passages which may be exposed or covered by telescoping movement of the outer sleeve to adjust the amount of diluent air admitted to the cigarette. As the outer sleeve is telescopically moved to increase the amount of diluent air admitted, it also compresses the filter element to cause an increase in pressure drop of the cigarette and thus compensate for the decrease in pressure drop resulting from the increased admission of diluent air.

12 Claims, 2 Drawing Sheets

ADJUSTABLE AIR DILUTION CIGARETTE WITH PRESSURE DROP COMPENSATION

FIELD OF THE INVENTION

The present invention relates to smoking articles, and more particularly to adjustable air dilution smoking articles with pressure drop compensation.

DESCRIPTION OF THE PRIOR ART

Cigarettes are popular smoking articles which have a substantially rod-shaped structure and include a charge of tobacco (i.e., in cut filler form surrounded by a paper wrapper thereby forming a tobacco rod. Some cigarettes are provided with a filter element constructed from a rod of fibrous material, such as cellulose acetate, overwrapped with a sheet material. Typically, a filter element is aligned in an end-to-end relationship with the tobacco rod and is attached to the tobacco rod using a circumscribing tipping material. Ventilation of the filter element or the tobacco rod may be employed to provide air diluted delivery of smoke to the user.

As used herein, the term "air dilution" refers to ambient air as a diluent, and is the ratio (generally expressed as a percentage) of the volume of air drawn through the air dilution means to the total volume of air and aerosol drawn through the smoking article and exiting the extreme mouth end portion of the smoking article. For air diluted or ventilated smoking articles of this invention, the amount of air dilution can vary. Preferably, the amount of air dilution for a cigarette is greater than about 20 percent, more preferably greater than about 30 percent. The upper limit of air dilution for a cigarette typically is less than about 80 percent, more frequently less than about 60 percent.

Filtration of the smoke and ventilation of the filter or tobacco rod can affect the flavor of a cigarette. As ventilation or air dilution is increased, the ratio of smoke to air is decreased thereby reducing flavor. Inasmuch as the air dilution of most commercially available cigarettes is fixed at the factory, a smoker of a particular air diluted cigarette is forced to change brands in order to obtain a cigarette having a different air dilution but similar taste.

"Pressure drop" is defined herein as the difference in pressure between two points in the cigarette flow system, usually from the lighted end to the draw end of the cigarette. Typically, pressure drop is measured for cigarettes at an air flow rate of 17.5 cc/sec using a pressure drop tester, such as the Model FTS-300 from the Filtrona Corporation. The magnitude of pressure drop affects the "draw" of a cigarette on the suction pressure the smoker applies to the draw end of the cigarette to smoke the cigarette, i.e., a greater pressure drop requires a greater suction pressure or drawing effort by the smoker.

In recent years, a number of variable air dilution cigarettes have been proposed as evidenced by U.S. Pat. Nos. 4,433,696 to Adams; 4,527,573 to Hausermann; and 4,526,183 to Nichols et al. One of the main drawbacks of such variable air dilution cigarettes is the variation in pressure drop associated with the cigarettes. In particular, an increased air dilution of the cigarette usually results in a lower pressure drop of the cigarette experienced by the smoker so that the greater the air dilution the less drawing effort is required by the smoker. Such variable pressure drops are highly undesirable in that a smoker must alter his/her usual smoking pattern or practice to compensate for the variation in pressure drop. Most often, the smoker must resort to various degrees of drawing effort when smoking cigarettes with variable air dilution settings. It would be desirable, therefore, to provide a variable air dilution cigarette which has a substantially constant pressure drop throughout the entire range of variable air dilution settings.

One attempt to provide a solution to the aforementioned pressure drop problem is disclosed in U.S. Pat. No. 4,532,943 to Nichols et al which discloses an adjustable air delivery filter cigarette comprising a first mouth-end segment of filter tow axially connected to a second tobacco rod-end segment of filter tow for relative rotation about the cigarette axis. Passages in the first and second segments are adapted to be in varying degrees of registry upon relative rotation of the segments to vary the resistance to draw of the cigarette. Such an adjustable delivery cigarette having a variable resistance to draw would appear to provide a change in resistance to draw only upon essentially complete misalignment of the passages. Thus, it is to be expected that such a cigarette would exhibit numerous air dilution settings while having essentially only two resistance to draw settings. In addition, it would appear that an adjustable delivery cigarette having a variable resistance-to-draw value is difficult to manufacture as the passages would have to be formed misaligned (i.e., into the high resistance-to-draw setting) when the high air dilution opening is provided, and realigned into the low air dilution setting (i.e., the low resistance-to-draw setting) for packaging.

Also known in the art are smoking articles having a controlled pressure drop such as those disclosed in U.S. Pat. Nos. 3,774,622 to Steigerwald; 3,695,274 to Summers; 4,343,319 to Cantrell; and 4,380,241 to Horsewell. However, the smoking articles disclosed in those patents do not provide for variable air dilution.

U.S. Pat. Nos. 4,649,941 to Norman et al and 4,649,945 to Norman et al, both assigned to the assignee of the present invention, disclose adjustable air dilution cigarettes which exhibit a controlled pressure drop and are capable of providing substantially constant smoking characteristics at various air dilution levels. In both those devices, pressure drop decrease during air dilution is advantageously controlled by varying the effective length of the path traveled by the dilution air.

In U.S. Pat. No. 4,700,725 to Geiszler, a filter cigarette is disclosed in which the tipping paper has a first opening and the filter element has an opening underlying the first opening. The openings are axially aligned over a mouth-end segment of the filter or a rod-end segment such that rotation of the mouth-end segment varies the register between the openings, thus varying the air dilution value of the cigarette. Rotation of the rotatable element is limited by stop elements to avoid rotation of the dilution mechanism beyond the maximum and minimum dilution points.

SUMMARY OF THE INVENTION

In view of the foregoing, it should be apparent that it would be advantageous to provide a smoking article, such as a cigarette, with a variable air dilution filter assembly which will maintain a substantially constant pressure drop throughout the entire range of air dilution levels. In that regard, the present invention provides an advantageous alternative to the aforesaid U.S. Pat. Nos.

4,649,941 and 4,649,945. It is therefore a primary objective of the present invention to fulfill a need in the art by providing an adjustable air dilution filter with means for simultaneously compensating for pressure drop to maintain a substantially constant pressure drop over the entire range of air dilution settings.

Another object of the present invention is to provide a variable air dilution cigarette filter assembly comprising a first sleeve housing a filter rod and having an array of air dilution openings, and a second sleeve mounted over the first sleeve for telescoping axial movement relative to the first sleeve to expose selected ones of the air dilution openings while applying a compression force to the filter rod which increases in proportion to the increase in the number of air dilution openings exposed.

Yet another object of the present invention is to provide a variable air dilution cigarette filter in which the amount of air dilution can be varied during smoking of the cigarette while simultaneously maintaining a substantially constant pressure drop of the cigarette.

As will be described in greater detail hereinafter in the description of the preferred embodiments, the variable air dilution cigarette filter of the present invention comprises a multi-piece filter assembly including a tubular inner sleeve in one end of which a filter element is disposed, and a multi-part tubular outer sleeve surrounding the tubular inner sleeve concentrically, with at least one part of the outer sleeve being telescopically moveable axially along the inner sleeve. As used herein, the term "telescopic" means extension or retraction by the relative axial movement between overlapping concentric tubular elements.

The tubular inner sleeve comprises (i) a first or tobacco rod end portion adapted to mate with one end of a tobacco rod, (ii) a second or mouth end portion within which the filter element is secured, and (iii) a connecting portion disposed between the first and second end portions. The circumferential wall of the connecting portion is formed with at least one series of longitudinally spaced air dilution perforations to allow air to pass through the wall of the inner sleeve and into a space between the confronting ends of the filter rod element and the tobacco rod.

The inside diameter of the inner sleeve is preferably essentially constant over the entire longitudinal extent thereof. The outside diameters of the connecting and first end portions of the inner sleeve are also essentially constant. The exterior surface of the connecting and first end portions of the inner sleeve are provided with a plurality of circumferential grooves and ridges. Preferably, the grooves and ridges on the connecting portion are rounded in longitudinal cross-section and those on the first end portion are generally square in longitudinal cross-section. The outside diameter of the second or mouth end portion increases from the diameter of the connecting portion to a greater diameter at the free end thereof. In other words, the exterior surface of the mouth end portion is tapered outwardly from the connecting portion toward its free end. The circumferential wall of the mouth end portion of the inner sleeve is provided with a plurality of arcuately spaced, longitudinal slots extending radially through the wall thereby forming a plurality of flexible or resilient fingers at the tapered mouth end portion of the inner sleeve.

The tubular outer sleeve comprises two portions, a first outer sleeve portion and a second outer sleeve portion, both having the same outer diameter and together having essentially the same length as the inner sleeve. The first outer sleeve portion is received on and has a length substantially equal to the first end portion of the inner sleeve. The free ends of the first outer sleeve and the first end portion of the inner sleeve abut one end of the tobacco rod and are secured thereto by tipping paper in a conventional manner. Circumferential grooves and ridges on the interior surface of the first outer sleeve portion interengage with and are complementary to the generally square circumferential grooves and ridges on the exterior surface of the first end portion of the inner sleeve to fix the first outer sleeve portion axially relative to the inner sleeve.

The second outer sleeve portion is telescopically received over the other end of the inner sleeve and surrounds the mouth end and connecting end portions of the inner sleeve. The diameter of a section of the inside circumferential surface of the second outer sleeve increases from a point intermediate the length thereof to one free end to thereby form a tapered interior surface complementary to the tapered exterior surface of the mouth end portion of the inner sleeve. The other section of the inside circumferential surface of the second outer sleeve is provided with rounded circumferential grooves and ridges complementary to those in the exterior surface of the connecting portion of the inner sleeve.

The mating rounded grooves and ridges on the second outer sleeve and the connecting portion of the inner sleeve are designed so that the ridges of each sleeve ride over one another when the inner and second outer sleeve portions are urged axially with respect to one another. Such an arrangement of rounded cooperating grooves and ridges provides means for the incremental axial movement of the second outer sleeve relative to the inner sleeve in predetermined increments equivalent to the crest-to-crest spacing of the ridges.

In use, axial telescoping movement of the second outer sleeve away from the first outer sleeve incrementally along the exterior of the inner sleeve exposes one or more of the longitudinally spaced air dilution perforations in the connecting portion of the inner sleeve thereby allowing an increasing amount of diluent air to pass through the perforations into a space between the confronting ends of the tobacco rod and the filter element. Ordinarily, increasing the amount of air dilution would result in a decrease in the pressure drop of the cigarette. However, simultaneously with the exposure of the air dilution perforations, the tapered interior surface of the second outer sleeve bears upon the tapered exterior of the resilient fingers of the mouth end portion of the inner sleeve and urges all the fingers radially inwardly. The radially inward movement of the fingers urges them against the outer surface of the filter element thereby radially compressing the filter element and constricting the flow passages in the filter element. The constricted flow through the filter element causes an increase in the pressure drop of the cigarette substantially equal to the decrease in the pressure drop of the cigarette resulting from increasing the amount of air dilution. The result is no net change in pressure drop of the cigarette so that the drawing effort required of the smoker remains substantially constant regardless of the amount of dilution air admitted through the air dilution perforations.

The variable air dilution cigarette filter in accordance with the present invention allows the user to select the desired amount of diluting air. Such selection can be made when the cigarette is lighted and can be varied during the smoking of each cigarette. Further, since the construction of the cigarette filter assembly is essentially uniform from cigarette to cigarette, the individual smoker can readily pre-select the desired degree of air dilution for each cigarette.

The present invention advantageously provides the user of an adjustable delivery air dilution smoking article with a useful, efficient and effective method for achieving the desired advantages of adjustable air dilution of the smoking article and simultaneous compensation of pressure drop so as to maintain a substantially constant pressure drop of the smoking article for all levels of air dilution. The user of the present invention can easily manipulate the sleeve components of the filter assembly to expose a desired number of air dilution passages and hence vary the air dilution characteristics of the smoking article.

For those smokers who do not choose to add diluting air to their smoke, the cigarette filter in accordance with the present invention can be set for zero air dilution. Cigarettes equipped with the variable air dilution cigarette filter of the present invention can thus be enjoyed by all smokers whether or not they choose to avail themselves of the variable air dilution feature.

The variable air dilution cigarette filter in accordance with the present invention is quite uncomplicated in structure, consisting primarily of a thin walled, generally rigid or semirigid sleeve or tube, preferably of a molded plastic material, having one or more slots or perforations, and one end of which receives a filter element and the other end of which mates with a tobacco rod. The unit manufacturing cost of cigarettes which include the variable air dilution filter of the invention is not appreciably higher than the cost of conventional filtered cigarettes. Further, the filter assembly in accordance with the present invention, is readily usable with conventional cigarette making equipment. Hence, there is no large additional tooling or equipment costs required to adapt existing cigarette-making machinery to the production of cigarettes which have the variable air dilution filter assembly of the present invention.

BRIEF DESCRIPTION OF THE DRAWINGS

A full and complete understanding of the features of the variable air dilution cigarette filter, in accordance with the present invention, may be obtained by referring to the following detailed description, and to the accompanying drawings in which.

DETAILED DESCRIPTION OF THE INVENTION

Figure 2:
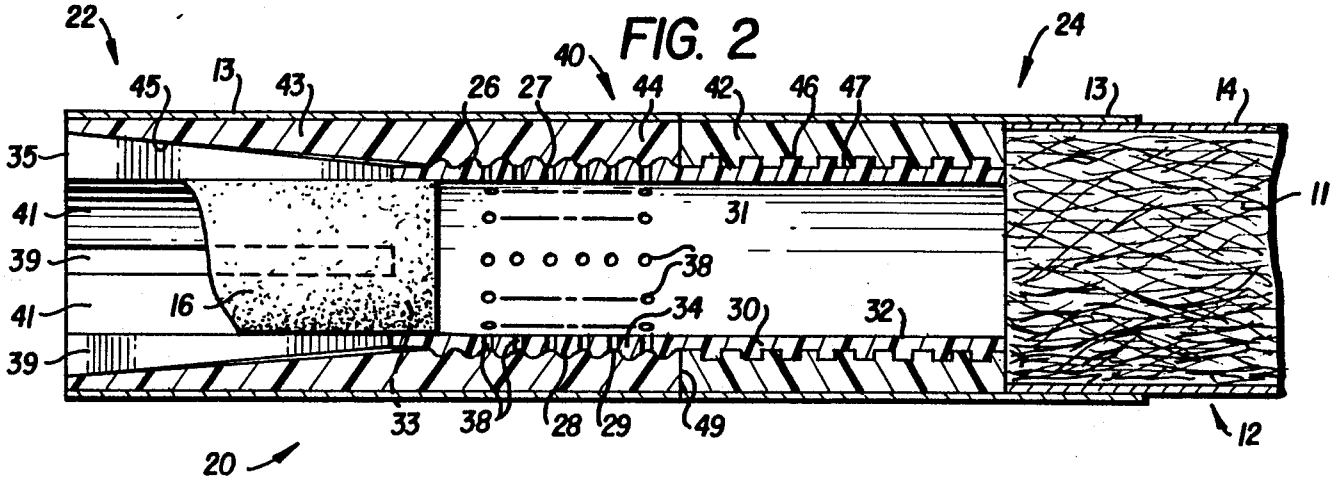
FIG. 2 is a cross-sectional side view of the cigarette filter of FIG. 1 and illustrates the preferred method of securing a tobacco rod to the cigarette filter.

A preferred embodiment of the present invention is illustrated in FIGS. 1–4 and constitutes a smoking article 10 in the form of a filter cigarette. The smoking article comprises a generally cylindrical rod 12 of smokable material 11, such as smokable cut filler, contained in a circumscribing wrapping material 14. The rod 12 of smokable material is hereinafter referred to as a "smokable rod" or a "tobacco rod." The ends of the tobacco rod are open to expose the smokable material. The smoking article 10 also includes a filter device or filter assembly 20 positioned adjacent one end of the tobacco rod. Tipping paper 13 is circumferentially wrapped about the mating ends of the filter assembly and tobacco rod 12 to secure them together.

Figure 4:
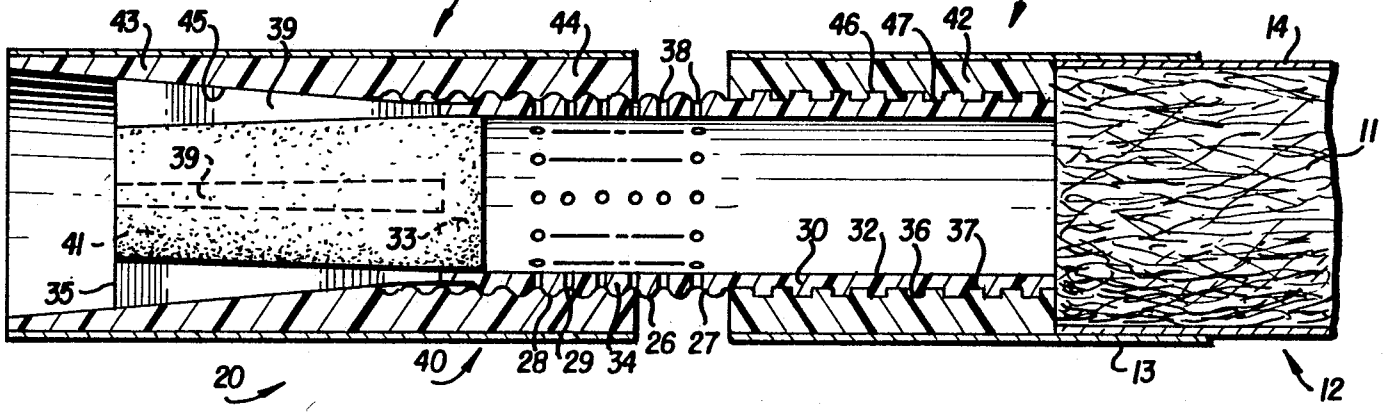
FIG. 4 is a side view, shown in cross-section, of the filter of the variable air dilution cigarette of FIG. 3.

A length of filter material 16 is pOsitiOned in the filter assembly 20 and is referred to hereinafter as a "filter element." Filter element 16, shown partially cut away in FIGS. 2 and 4, is generally cylindrical and the diameter thereof is smaller than the diameter of the tobacco rod 12. Both ends of the filter element 16 are preferably unobstructed to permit the passage of air and smoke therethrough. The filter element 16 typically comprises a length of a filter rod made of a filter material, such as cellulose acetate or polypropylene, tobacco material or the like, which is overwrapped about the circumferential surface thereof with a plug wrap material (not shown).

The filter assembly 20 comprises a tubular inner sleeve 30 and a two-piece tubular outer sleeve 40. The filter assembly 20 has a generally cylindrical external surface, with a first end 24 to which the tobacco rod 12 is secured by tipping paper 13 and a second, mouth-engaging end 22 which the smoker places between his/her lips to draw smoke and air through the cigarette. The second end 22 of the filter device 20 is hereinafter referred to as the "mouth end" of the filter assembly, and the first end 24 is hereinafter referred to as the "tobacco rod end" of the filter assembly.

The tubular inner sleeve 30 comprises an elongated cylindrical member having an axially extending bore 31 passing therethrough from the mouth end 22 to the tobacco rod end 24. The inner sleeve includes a first or tobacco rod end portion 32 to which the tobacco rod 12 is attached, a second or mouth end portion 33 within which the filter element 16 is carried, and a perforated connecting portion 34 which integrally interconnects the tobacco rod end portion 32 with the mouth end portion 33. The diameter of the bore 31 is preferably essentially constant throughout the entire longitudinal extent of the inner sleeve, and is of a dimension which is equal to or slightly less than the outer diameter of the filter element 16. It is contemplated within the scope of the invention that the diameter of bore 31 and tobacco rod 12 are equal or slightly interferring so that the tobacco rod may be inserted in the bore 31.

The external diameter of the cylindrical inner sleeve member 30 has a generally constant diameter along the tobacco rod end portion 32 and the air dilution connecting portion 34. The mouth end portion 33 has an outwardly tapered surface, that is, a diameter which increases from the connecting portion 34 to the free end 35 of the mouth end portion 33, thus defining a generally conical exterior surface of the mouth end portion of the inner sleeve.

The exterior tapered surface of the mouth end portion 33 is smooth, whereas the exterior surfaces of the connecting portion 34 and the tobacco rod end portion 32 are provided with alternating ridges 26, 36 and grooves 27, 37, respectively, for a purpose to be described. The ridges 26, 36 and grooves 27, 37 may be disposed either in transverse planes perpendicular to the longitudinal axis of the sleeve member, as shown in the drawings, or provided in a helical manner, as in a helical thread. Preferably, the ridges 26 and grooves 27 and rounded and the ridges 36 and grooves 37 are square.

A plurality of perforations 38 are provided in the connecting portion 34 in longitudinally aligned arrays circumferentially disposed about the connecting portion 34. The perforations of each array extend through the annular wall of the connecting portion 34 preferably in planes perpendicular to the longitudinal axis of the annular member and are located in the grooves 27. Longitudinally extending, circumferentially spaced slots 39, preferably four in number, are provided in the annular wall of the mouth end portion 33. The slots 39 extend from the end surface 35 of the mouth end portion 33 toward the connecting portion 34, and terminate approximately at the location at which the taper of the mouth end portion 33 begins. The annular wall sections of the mouth end portion between the slots 39 comprise a plurality of resilient fingers 41 which, together with the slots, facilitate radial constriction and expansion of the mouth end portion 33.

The multi-part tubular outer sleeve 40 includes a first sleeve portion 42 at the tobacco rod end of the filter assembly 20 and a second sleeve portion 43 at the mouth end of the filter assembly. The first sleeve portion 42 has an axial length which is substantially equal to the axial length of the tobacco rod end portion 32 of the inner sleeve. The internal annular surface of the first outer sleeve portion 42 is provided with alternating annular grooves 46 and ridges 47 which are substantially square in cross-section and complementary with the ridges 36 and grooves 37 provided On the external annular surface of the tobacco rod end portion 32. The complementary ridges and grooves may be forced over one another upon the application of sufficient force to position the tobacco rod end portion 32 as shown in the drawings. When the sleeve portions 32, 42 are properly positioned, the ridges and grooves interengage and coact, along with a suitable adhesive between the mating annular surfaces, to restrain the first sleeve portion 42 from moving axially relative to the tobacco rod end portion 32. The first outer sleeve 42 may be provided integrally in one piece with the tobacco rod end portion 32 of the inner sleeve. However, the two-part construction of the outer sleeve facilitates initially positioning the second outer sleeve 43 on the inner sleeve by telescopically sliding the same axially over the inner sleeve from the direction of the tobacco rod end portion 32. The tipping paper 13 may be wrapped about the entire outer sleeve 40, and cut circumferentially at the interface 49 between the outer sleeve members 42,43.

The second outer sleeve 43 is a tubular member having a longitudinally extending bore, an essentially constant external diameter and an axial length substantially equal to the combined axial lengths of the connecting portion 34 and the mouth end portion 33 of the inner sleeve 30. The second outer sleeve 43 includes a first cylindrical portion 44 and a second portion 45. The internal circumferential surface of the second portion 45 is a continuous smooth surface which tapers conically outwardly from the first cylindrical portion 44 to the free end thereof. The internal circumferential surface of the first cylindrical portion 44 is provided with alternating annular rounded grooves 28 and ridges 29. The rounded grooves 28 and ridges 29 are formed in such manner as to be complementary to ridges 26 and grooves 27 provided in the external surface of the connecting portion 34 of the inner sleeve.

Figure 1:
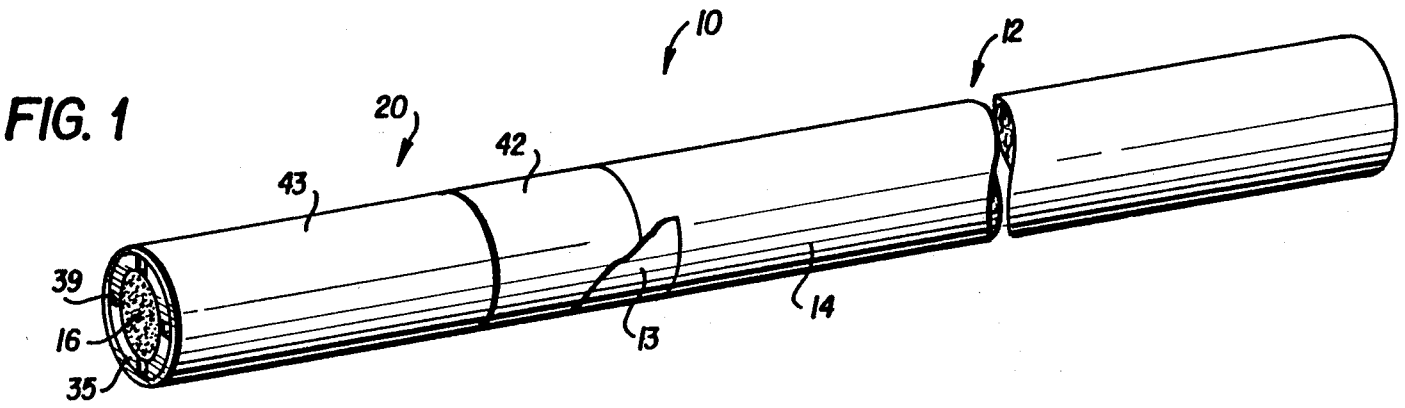
FIG. 1 is a perspective view partly broken away of a cigarette with a variable air dilution filter in accordance with the present invention, with the cigarette filter set for no air dilution.
Figure 3:
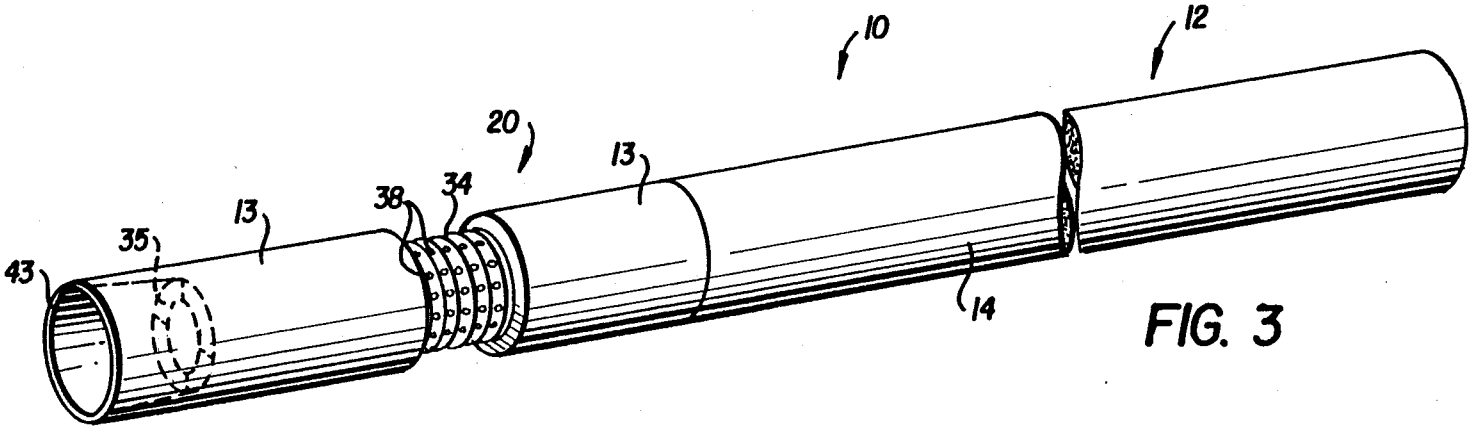
FIG. 3 is a perspective view of the variable air dilution cigarette of FIG. 1 with the cigarette filter adjusted for a given amount of air dilution.

In operation, the second outer sleeve 43 is initially installed on the inner sleeve 30 at a position relative to the inner sleeve such that the first cylindrical portion 44 is disposed concentrically about the connecting portion 34 of the inner sleeve and the second tapered portion 45 is disposed concentrically about the mouth end portion 33 of the inner sleeve. (FIGS. 1 and 2). In this "zero air dilution" position, the free end of the first cylindrical portion 44 is located closely adjacent or abutting the end of the first outer sleeve 42, and covers all the perforations 38 in the connecting portion 34, i.e., essentially no air dilution during use. From this initial installation position, the second outer sleeve 43 is adapted to be moved axially along the inner sleeve assembly away from the first outer sleeve 42 and back toward the first outer sleeve.

In the embodiment shown in the various figures of the drawings, wherein the ridges and grooves are disposed in planes perpendicular to the longitudinal axis of the inner sleeve member 30, the second outer sleeve 43 is movable axially of the inner sleeve 30 in a stepwise manner from the position shown in FIG. 2 to one of several discrete "air dilution" positions, as for example, the position shown in FIG. 4. Such stepwise axial movement of the cylindrical portion along the inner sleeve member is made possible by the coaction of the alternating annular rounded ridges 26 and grooves 27 in the external surface of the connecting portion 34 of the inner sleeve with the alternating annular rounded grooves 28 and ridges 29 in the internal surface of the cylindrical portion 44 of the second outer sleeve. The coacting rounded grooves and ridges are designed to easily "ride" or "snap" over one another in a stepwise manner when opposite axial forces are applied to the opposite ends of the inner sleeve and the second outer sleeve, as, for example, by a smoker who grasps the exterior surfaces of the first and second outer sleeves 42, 43 and moves them away from or toward one another.

In the alternate embodiment in which the alternating ridges and grooves in the external surface of the inner sleeve 30 and the internal surface of the cylindrical portion 44 of the second outer sleeve are provided in a helical manner, movement of the cylindrical portion 44 axially along the inner sleeve 30 may be accomplished by grasping the exterior surfaces of the first and second outer sleeves 42, 43 and applying an appropriate rotational torque to one or the other of the sleeve components 42, 43, or opposite torques to the outer sleeves, to thereby move or "thread" the second outer sleeve 43 axially relative to the first outer sleeve. Construction of the ridges and grooves as a helical thread does not permit the stepwise adjustment of air dilution possible with the annular ridges and grooves, but does permit adjustment to an "infinite" number of air dilution levels. In addition, when a helical thread is used the thread may be rounded, square or triangular in cross-section along the entire length thereof.

The conical or tapered portion 45 of the bore in the second outer sleeve 43 preferably has the same degree of taper as the external conical surface of the mouth end portion 33 of the inner sleeve so that in the zero air dilution position illustrated in FIGS. 1 and 2 the tapered surfaces of the inner and outer sleeves are congruent as shown and the inside diameter of the mouth end portion 33 is essentially constant along its length. As the second outer sleeve 43 is moved axially away from the first outer sleeve 42 toward the position depicted in FIGS. 3 and 4, the tapered surface 45 slides along the tapered outer surfaces of the resilient fingers 41 and urges the resilient fingers radially inwardly against the exterior surface of the filter element 16 to circumferentially compress the latter.

The filter assembly of the present invention is designed to provide a cigarette with a variable amount of air dilution, as well as a substantially constant pressure drop for all variations of air dilution. Two extreme settings of air dilution are possible, namely, a first "zero air dilution" setting as shown in FIG. 2, and a second "maximum air dilution" setting. Between these first and second extreme settings of air dilution are the various settings which correspond to proportionally increasing air dilution resulting from a greater number of perforations being exposed, e.g., the FIG. 4 setting. The substantially constant pressure drop that is maintained at the mouth end of the filter assembly, simultaneously with increased or decreased air dilution is effected by means of the coaction or interaction between the tapered bore portion 45 of the second outer sleeve 43 with the tapered exterior surface of the resilient fingers 41 of the mouth end portion 33. By such coaction, the resilient fingers 41 are compressed radially inwardly, so that the internal cylindrical surface of the mouth end portion 33 (as shown in FIG. 2) becomes inwardly tapered toward the mouth end 35 (as shown in FIG. 4), i.e., the internal diameter of the mouth end portion 33 at the free end surface 35 thereof is less than the internal diameter of the connecting portion 34 and the tobacco rod end portion 32. As a result of this reduction or constriction in diameter, the filter element 16 is circumferentially compressed. Thus, the amount of suction needed by a smoker to draw air through the filter element 16 will be increased. But, because the opening of the air dilution passages 38 causes an equivalent decrease in the pressure drop of the cigarette, total pressure drop of the cigarette remains substantially constant.

It is contemplated that in the preferred embodiment of the invention, the tobacco rod 12 will be the same diameter as the filter assembly 20 and be secured by tipping paper 13 to tobacco rod end portion 32 in the manner shown in FIG. 2. However, it is also contemplated that the outer diameter of the tobacco rod 12 may correspond to the diameter of bore 31. Under such circumstances, the tobacco rod 12 would be inserted into and secured, e.g., by an adhesive in the bore 31.

The taper angle of the mating conical surface 45 of the second outer sleeve 43 and the conical exterior surface of the mouth end portion 33 of the inner sleeve will depend primarily upon the pressure drop characteristics of the filter element and the volume of air dilution provided by the air dilution portion of the filter assembly. An appropriate taper angle for given filter element and air dilution configuration may be experimentally determined by using the aforesaid pressure drop tester of the Filtrona Corporation. Taper angles on the order of ¼° to 1° are contemplated.

The filter assembly preferably has a length in the range of about 26 mm to 28 mm and a circumference of about 24 mm to 28 mm. The tubular inner and outer sleeves of the filter assembly may be formed of any suitable material, but are preferably molded or extruded of a plastic material, such as polyethelene or polypropylene with wall thicknesses of about 0.5 mm to 2 mm. The sleeves may also be formed of paper tubes or other organic fibrous products, such as reconstituted tobacco or the like. The ridges and grooves on the inner and outer groove surfaces may be formed during the molding or extrusion of the sleeves or may be subsequently formed, for example, by machining or rolling with heated forming dies. The number of air dilution passages 38 in the connecting portion 34 may range from about 10 to about 20 holes and may have a diameter from about 0.5 mm to about 1 mm.

In the present invention, the tobacco rod 12 typically has a length which ranges from about 50 mm to about 85 mm, a circumference of about 17 mm to about 27 mm; and the wrapping material thereof is a conventional cigarette wrapping paper. If desired, a dual wrapper system can be employed. The tobacco rods and the resulting cigarettes can be manufactured in any known configuration using known cigarette-making techniques and equipment.

The filter element of the invention has a length which ranges from about 10 mm to about 35 mm and a circumference of about 17 mm to about 27 mm. The filter material can be any suitable material such as cellulose acetate, polypropylene, tobacco material, or the like. Filter materials having compositions or characteristics so as to exhibit low nicotine filtration efficiencies can be employed. The filter may be wrapped with a conventional paper plug wrap, which can be either air permeable or essentially air impermeable. However, if desired, a nonwrapped cellulose acetate filter rod can be employed. The various filter rods suitable for making a filter element useful in this invention can be manufactured using known cigarette filter making techniques and equipment.

A tipping material is used to attach the tobacco rod to the filter device. Typically, the tipping material circumscribes the filter device and an adjacent region of the tobacco rod such that the material extends about 3 mm to about 6 mm along the length of the tobacco rod. The tipping material is a conventional paper tipping material which can have a variable porosity. For example, the tipping material can be essentially air impermeable, air permeable, or be treated (e.g., by mechanical or laser perforation techniques) so as to have a region of perforations, openings or vents thereby providing an additional means for providing air dilution to the cigarette. The total surface area of the perforations and the positioning of the perforations along the periphery of the smoking article can be varied in order to control the performance characteristics of the smoking article.

The smokable material employed in the manufacture of the smokable rod can vary. For example, the smokable material can be engineered in a processed form such as an extruded form, have the form of filler, such as cut filler, or the like. Generally, the smokable material of cigarettes has the form of cut filler. The terms "filler" or "cut filler" are meant to include smokable materials which have a form suitable for use in the manufacture of cigarette tobacco rods. As such, filler can include materials which are blended, cased and flavored, and are in a form ready for cigarette manufacture. The smokable filler materials conveniently are emplOyed in the form of strands or shreds as is common in conventional cigarette manufacture. For example, the smokable cut filler material can be employed in the form of strands cut into widths ranging from about 1/25 inch to about 1/60 inch, preferably from about 1/30 inch to about 1/40 inch. Generally, such strands have lengths which range from about 0.25 inch to about 3 inches.

Preferably, the majority of the filler material present in the smokable rod is a smokable material such as tobacco material, or a blend thereof with a tobacco substitute material. Examples of suitable tobacco materials include flue-cured, Burley, Maryland or Oriental tobaccos; processed tobacco materials such as expanded tobaccos, processed tobacco stems, reconstituted tobacco materials or reconstituted tobacco materials having varying levels of endogenous and exogenous nicotine; or blends thereof. If desired, the tobacco materials can be blended with small amounts of carbonized and/or pyrolyzed materials.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A cigarette including a rod of smokable material and a filter element, said cigarette comprising filter assembly means for connecting the filter element to the smokable rod, said filter assembly means including air dilution means for admitting diluent air to the cigarette, means for adjusting the amount of diluent air admitted to the cigarette, and means for increasing the pressure drop of the cigarette as the amount of diluent air is increased, said means for increasing the pressure drop comprising means for supplying a compressive force to the filter element as the amount of diluent air admitted to the cigarette is increased.

2. The cigarette according to claim 1, said filter assembly comprising telescoping inner and outer sleeves, said compressive force applying means comprising a mouth end portion of said inner sleeve having a plurality of longitudinal slots extending radially therethrough forming a plurality of resilient fingers, said filter element being disposed in said mouth end portion, and means coating between said inner and outer sleeves for urging said resilient fingers radially inwardly into a compressive force relation with said filter element.

3. The cigarette according to claim 2, said coacting means comprising confronting tapered circumferential surfaces on the outer sleeve and the mouth end portion of the inner sleeve.

4. The cigarette according to claim 2, said inner sleeve further comprising a connecting portion, said air dilution means comprising a plurality of passages in the connecting portion of the inner sleeve, said means for adjusting the amount of diluent air comprising said outer sleeve telescoping over said connecting portion to expose a selected number of said passages.

5. The cigarette according to claim 2, said inner and outer sleeves having confronting circumferential surfaces and means on said surfaces for incrementally adjusting the telescoping of said outer and inner sleeves relative to one another.

6. The cigarette according to claim 5, said incrementally adjusting means comprising one of a plurality of complementary annular grooves and ridges or a helical thread.

7. A cigarette comprising a rod of smokable material and a filter element, a filter assembly for connecting the filter element to the smokable rod, said filter assembly comprising an inner and an outer sleeve with an axial bore, said inner sleeve having an axial bore and an annular wall with a plurality of perforations extending therethrough for admitting diluent air to the cigarette, said filter element being disposed in said inner sleeve, said inner sleeve being received in the axial bore of outer sleeve, said outer sleeve being telescopically movable axially along said inner sleeve, said outer sleeve having an annular wall with an imperforate portion for selectively exposing or covering the perforations in the annular wall of the inner sleeve to increase or decrease, respectively, the amount of diluent air admitted to the cigarette, and means cooperating between said inner and outer sleeves for compressing the filter element as said outer sleeve is telescopically moved in a first axial direction over said inner sleeve, the compression of the filter element being increased as the amount of diluent air admitted to the cigarette is increased such that the pressure drop of the cigarette is maintained substantially constant.

8. The cigarette of claim 7, the compressing means comprising a tapered portion of the axial bore of the outer sleeve in coacting relation with a tapered portion of the exterior surface of the inner sleeve, said filter element being disposed in the axial bore of the inner sleeve inwardly of the tapered portions of the inner and outer sleeves, the telescopic movement of the outer sleeve over the inner sleeve in said first axial direction urging the tapered portion of the inner sleeve radially inwardly to apply a compressive force to the filter element.

9. A variable air dilution filter assembly for attachment to a smoking article, said filter assembly comprising an annular outer sleeve in telescoping relation over an annular inner sleeve, said inner sleeve comprising a mouth end portion, a tobacco rod end portion and a connecting portion therebetween, a filter element disposed in the mouth end portion of the inner sleeve, said connecting portion having a plurality of air dilution passages therethrough, said outer sleeve being telescopically movable over said connecting portion to expose selected ones of said passages and means cooperating between said inner and outer sleeves for increasing the pressure drop of the filter element as the number of exposed air dilution passages is increased.

10. The filter assembly of claim 9, said pressure drop increasing means comprising confronting tapered circumferential surfaces between the outer sleeve and the mouth end portion of the inner sleeve.

11. The filter assembly of claim 9, said pressure drop increasing means comprising a plurality of resilient fingers on the mouth end portion of the inner sleeve and means for urging said fingers radially inwardly into compressive force relation with the filter element.

12. The filter assembly of claim 11, said urging means comprising tapered surfaces on the interior circumferential surface of the outer sleeve and on the outer surfaces of the resilient fingers.

* * * * *